US007469112B2

(12) United States Patent
Yuasa

(10) Patent No.: US 7,469,112 B2
(45) Date of Patent: Dec. 23, 2008

(54) IMAGE FORMING APPARATUS HAVING AN AIR-COOLING SYSTEM

(75) Inventor: Hiroshi Yuasa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 100 days.

(21) Appl. No.: 11/535,537

(22) Filed: Sep. 27, 2006

(65) Prior Publication Data

US 2007/0071485 A1 Mar. 29, 2007

(30) Foreign Application Priority Data

Sep. 29, 2005 (JP) ..... 2005-284597

(51) Int. Cl.
*G03G 21/20* (2006.01)

(52) U.S. Cl. ..... 399/92; 399/94

(58) Field of Classification Search ..... 399/91, 399/92, 94

See application file for complete search history.

(56) References Cited

U.S. PATENT DOCUMENTS 5,325,158 A * 6/1994 Guelfo et al. ..... 399/92
5,479,242 A * 12/1995 Sato et al. ..... 399/92
5,749,039 A * 5/1998 Thomas ..... 399/92 X
6,075,956 A * 6/2000 Watanabe et al. ..... 399/92
6,141,512 A * 10/2000 Nagano et al. ..... 399/92
6,266,498 B1 * 7/2001 Oda et al. ..... 399/92
6,308,024 B1 * 10/2001 Nakayama et al. ..... 399/92 X
6,501,922 B2 * 12/2002 Ihara et al. ..... 399/92
6,754,458 B2 * 6/2004 Makihira ..... 399/92
2004/0234291 A1 * 11/2004 Iikawa et al. ..... 399/92
2005/0238379 A1 * 10/2005 Ogane et al. ..... 399/92

FOREIGN PATENT DOCUMENTS

JP 2004325762 A 11/2004
JP 2005-077478 A * 3/2005

OTHER PUBLICATIONS

Machine translation of JP 2005-077478 A dated Feb. 25, 2008.*

* cited by examiner

*Primary Examiner*—Sophia S Chen
(74) *Attorney, Agent, or Firm*—Panitch Schwarze Belisario & Nadel LLP

(57) ABSTRACT

An image forming apparatus includes an image forming section that forms a toner image. A transferring section transfers the toner image formed onto a recording medium. A fixing unit is located adjacent the image forming section such that a first space is defined between the fixing unit and the image forming section. The fixing unit fixes the toner image on the recording medium. An air-chamber includes a wind exit and discharges the air through the wind exit such that the air flows into the first space. An air-propelling device propels the air to discharge through the wind exit.

14 Claims, 12 Drawing Sheets

IMAGE FORMING APPARATUS HAVING AN AIR-COOLING SYSTEM

BACKGROUND OF THE INVENTION

1. Field of the Invention

The present invention relates to an image forming apparatus.

2. Description of the Related Art

A color printer is one of conventional image forming apparatuses such as printers, copying machines, facsimile machines and composite structure of these, i.e., multifunction printers (MFP). A color printer performs an electrophotographic image forming process. A charging roller charges the surface of a photoconductive drum. An LED head illuminates the charged surface of the photoconductive drum to form an electrostatic latent image. A thin layer of toner formed on a developing roller is deposited to the electrostatic latent image by the Coulomb force, thereby forming a toner image on the photoconductive drum. A transfer roller transfers the toner image onto paper. A cleaning unit removes the toner remaining on the photoconductive drum after transfer.

The paper having the toner image on it advances to a fixing unit where the toner image is fused into the paper.

A temperature sensor detects the temperature of the fixing unit. The temperature of the fixing unit is controlled in accordance with the detection output of the temperature sensor, so that the temperature of the fixing unit is within a predetermined range.

A fixing unit needs to generate a large amount of heat for printing on a variety of print paper at high speed. In addition, the fixing unit is disposed close to a photoconductive drum for compact design of the printer. Thus, the toner in a developing unit may melt due to the heat from the fixing unit.

A toner for high speed printing has a low-melting point, and therefore increases the chance of the toner melting due to the heat from the fixing unit. The result is a poor print quality.

SUMMARY OF THE INVENTION

The present invention was made to solve the problems of the conventional art.

An object of the present invention is to provide an image forming apparatus that improves the print quality and that is capable of printing at high speed.

Another object of the invention is to provide an image forming apparatus that prevents developer in the developing unit from melting.

An image forming apparatus includes an image forming section that forms a toner image. A transferring section transfers the toner image formed onto a recording medium. A fixing unit is located adjacent the image forming section such that a first space is defined between the fixing unit and the image forming section. The fixing unit fixes the toner image on the recording medium. An air-chamber includes a wind exit and discharges the air through the wind exit such that the air flows into the first space. An air-propelling device propels the air to discharge through the wind exit.

The fixing unit longitudinally extends in a first direction perpendicular to a second direction in which the recording medium is fed into the fixing unit, and the wind exit is located substantially longitudinal midway of the fixing unit.

The image forming apparatus further includes an outer casing that defines a second space in the image forming apparatus. The air-chamber defines a third space upstream of the wind exit, the third space communicating with the second space through a communication hole formed in the air-chamber.

The image forming apparatus further includes an outer casing that defines the second space over the developer reservoir and the image forming section.

The third space is substantially in the shape of a box that extends in parallel to the fixing unit.

The outer casing is formed with an opening at an upstream portion of the second space, the second space communicating with the atmosphere through the opening.

The outer casing includes a pair of opposing walls that project from the outer casing to define the second space.

The image forming section and the fixing unit extend such that the first space extends in a first direction perpendicular to a second direction in which the recording medium is fed into the fixing unit. The image forming apparatus includes a wind guide disposed downstream of the wind exit, the wind guide guiding the air to flow into longitudinal end portions of the fist space.

The air-propelling device is a fan disposed immediately upstream of the wind exit.

The air-propelling device is a fan disposed in the vicinity of the opening.

The wind exit is arranged substantially across a longitudinal dimension of the fixing unit perpendicular to a second direction in which the recording medium is fed into the fixing unit.

The image forming section is a one of a plurality of image forming sections closest to the fixing unit. The second space is defined between the outer casing and a partition that overlies the plurality of image forming sections. The partition is formed with openings through which the air flows into the fourth space defined between adjacent ones of the plurality of image forming sections.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

FIRST EMBODIMENT

Embodiments will be described in detail with reference to the accompanying drawings. An image forming apparatus will be described in terms of a printer.

Figure 1:
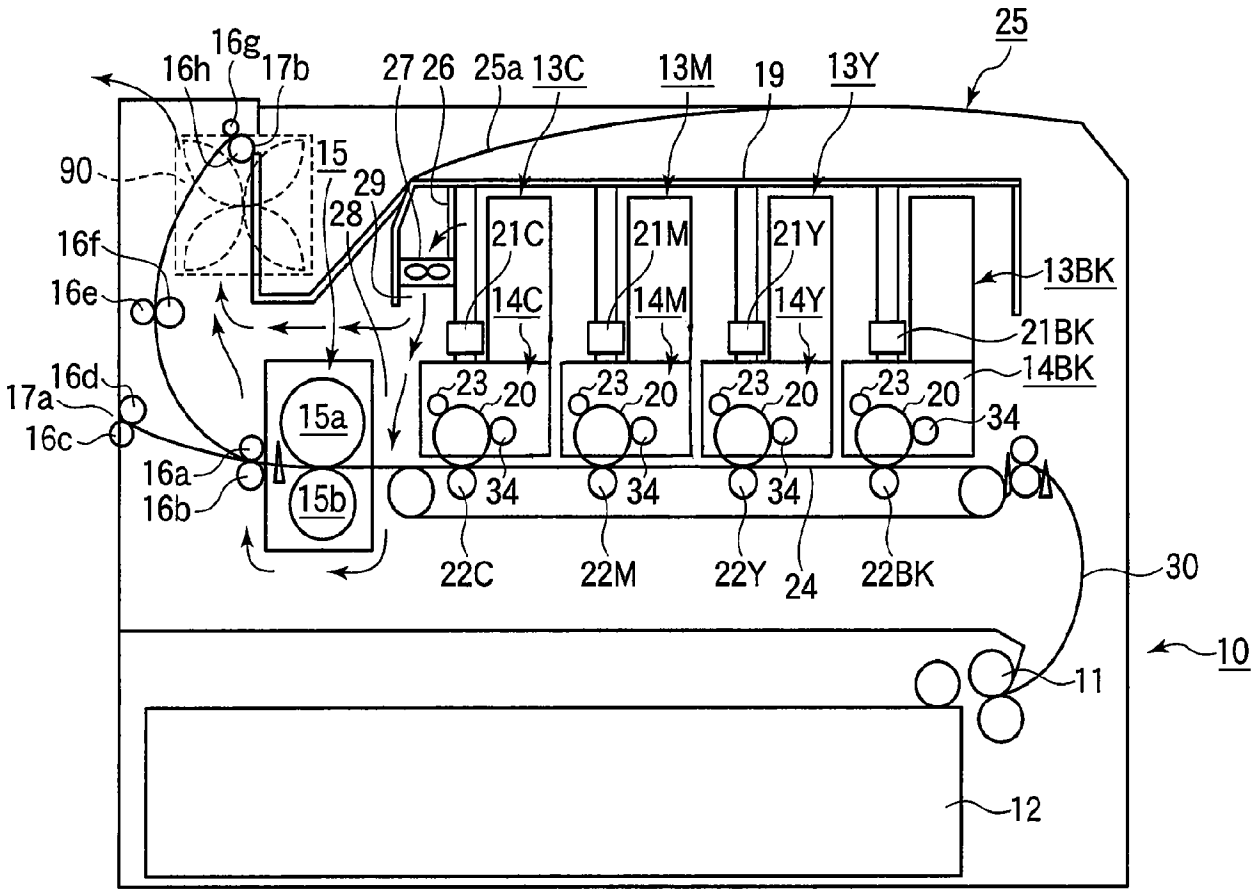
FIG. 1 is a cross sectional view illustrating the general configuration of a printer of a first embodiment.

FIG. 1 is a cross sectional view illustrating the general configuration of a printer 10 of a first embodiment.

Referring to FIG. 1, a feed roller 11 is driven in rotation by a drive source, not shown, to feed paper from a paper cassette 12 into a transport path 30. The paper is advanced in the transport path 30 in a laterally centered position with respect to the transport path 30. As the transfer belt 24 runs, the paper passes through image forming sections 14BK (black), 14Y (yellow), 14M (magenta), and 14C (cyan) in sequence, advancing through transfer regions defined between the respective photoconductive drums 20 and transfer rollers 22Y, 22M, 22C, and 22BK.

The image forming sections 14Y, 14M, 14C, and 14BK each include a photoconductive drum 20, a charging roller 23, and a developing roller 34.

The charging rollers 23, photoconductive drums 20, transfer rollers 22Y, 22M, 22C, and 22BK extend away from the observer, i.e., in directions substantially perpendicular to the direction of travel of the paper. The charging rollers 23 charge the surfaces of the corresponding photoconductive drums 20. LED heads 21BK (black), 21Y (yellow), 21M (magenta), and 21C (cyan) extend in parallel to the corresponding photoconductive drums 20, and illuminate the charged surfaces of the corresponding photoconductive drums 20 to form electrostatic latent images of corresponding colors. The LED heads 21Y, 21M, 21C, 21BK are supported at their longitudinal end portions so that they are in position.

The developing rollers 34 develop the electrostatic latent images with toners of corresponding colors into toner images. The transfer rollers 22Y, 22M, 22C, and 22BK transfer the respective toner images onto the paper one over the other in registration.

The paper then advances to a fixing unit 15. The fixing unit 15 extends in its longitudinal direction (i.e., away from the observer or in a direction perpendicular to the direction of travel of the paper). The paper passes through a fixing region defined between a heat roller 15*a* and a pressure roller 15*b*, so that the toner images on the paper are fixed into a full color permanent image. The paper then leaves the fixing unit 15, and is discharged by discharge rollers 16*a*-16*d* through a paper exit 17*a* to the outside of the case 25 or by discharge rollers 16*e*-16*h* through a paper exit 17*b* onto a stacker 25*a* formed on an outer case 25.

The toner reservoirs 13BK, 13Y, 13M, and 13C, hold black, yellow, magenta, and cyan toner, respectively, and are removably attached to the printer 10. The toner reservoirs 13BK, 13Y, 13M, and 13C and the image forming sections 14Bk, 14Y, 14M, and 14C can be attached to and detached from the printer 10 by opening the case 25 that overlie the toner reservoirs 13BK, 13Y, 13M, and 13C. A partition 19 is integral with the case 25. The LED heads 21BK, 21Y, 21M, and 21C are supported on the underside of the partition 19.

A fan 90 discharges the air in the image forming apparatus heated by excessive heat generated in the fixing unit 15 to the outside of the printer 10, thereby preventing the toner reservoirs 13Bk, 13Y, 13M, and 13C and the image forming sections 14BK, 14Y, 14M, and 14C from being affected by the heat.

Figure 2:
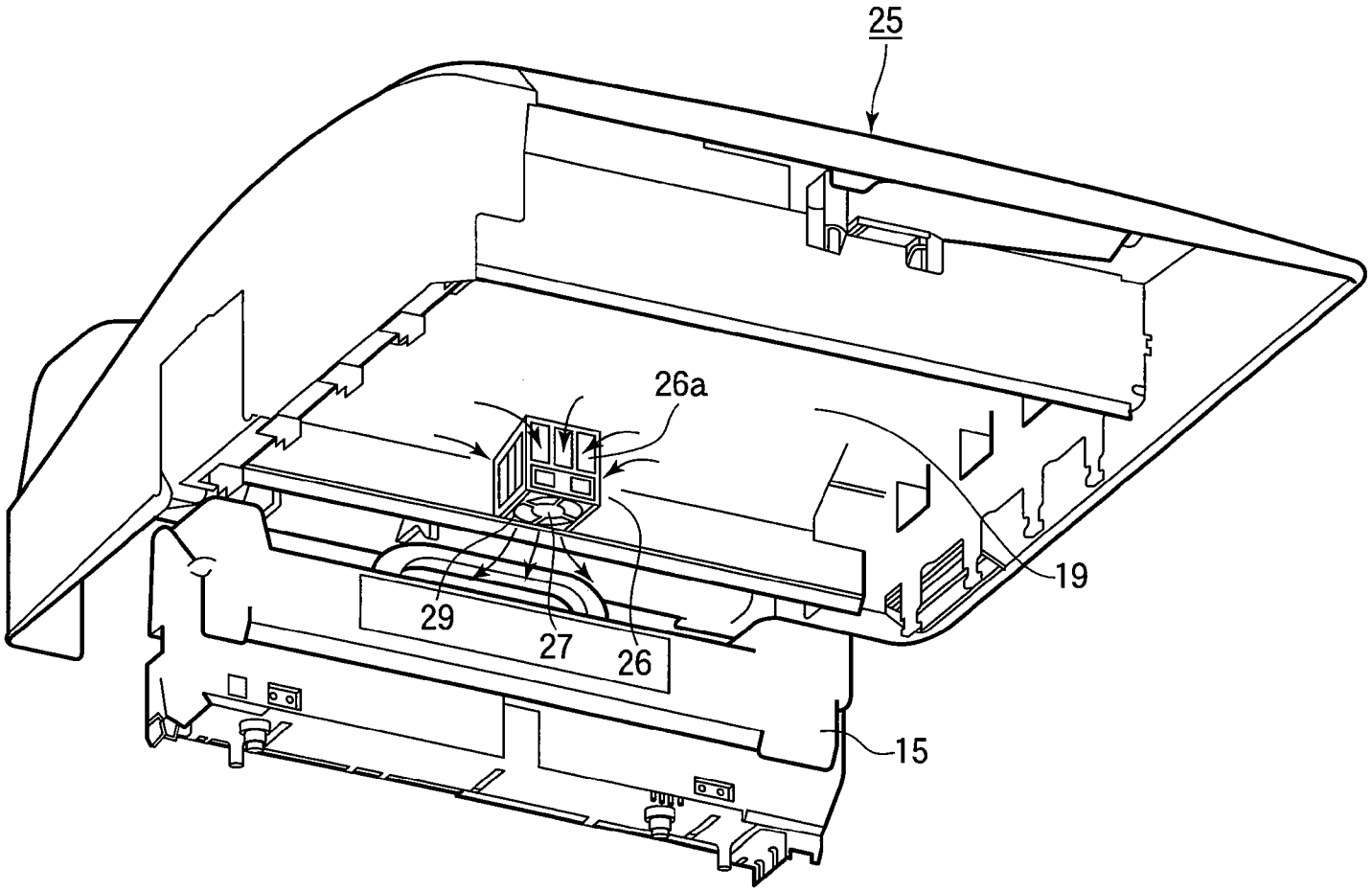
FIG. 2 is a perspective view illustrating a pertinent partition of the printer of the first embodiment.

FIG. 2 is a perspective view illustrating a pertinent partition of the printer 10.

Referring to FIG. 2, a fan holder 26 holds a fan 27 firmly, and is formed with openings 26*a* in its side walls. The fan holder 26 is disposed substantially over a first path 28 defined between the fixing unit 15 and the image forming section 14C, which is the closest one of the image forming sections 14BK, 14Y, 14M and 14C, to the fixing unit 15. The fan holder 26 is located substantially longitudinal midway of the fixing unit 15

The fan holder 26 is formed with a wind exit 29. When the fan 27 rotates, the air surrounding the fan holder 26 is sucked into the holder 26 through the opening 26*a*. The fan 27 then sends the air toward the wind exit 29, so that the air is ejected through the wind exit 29 into the first path 28. The flow of air forms a curtain of air such that the fixing unit is on one side of the curtain of air and the developer reservoir 13C and image forming section 14C are on the other side of the curtain of air.

The flow of air or wind shown by arrows (FIG. 2) into the first path 28 prevents the heat generated in the fixing units 15 from being transferred to the image forming section 14C.

The wind discharged from the wind exit 29 also cools the image forming section 14C. A portion of the wind flows over the fixing unit 15 as shown by arrows and is then discharged by the fan 90 to the outside of the printer 10.

Therefore, the heat generated by the fixing unit 15 will not cause the toner in the image forming section 14C to melt, even if the fixing unit 15 generates a large amount of heat required for printing on a variety of types of paper and for high speed printing, or the fixing unit 15 and the image forming section 14C are closely located for compact design of the printer 10.

Moreover, even if toner having a low melting point is used for high speed printing, the toner in the toner in the image forming section 14C will not melt. Thus, print quality may be improved.

The fan 27 is disposed not at an end portion of the width of the transport path 30 but substantially in the middle of the width of the transport path 30. Thus, the variation of cooling effect across the width of the image forming section 14C (i.e., away from the observer or in a direction perpendicular to the direction of travel of paper) may be minimized so that well-balanced cooling is achieved.

The aforementioned configuration eliminates the need for interrupting the printing operation for cooling the interior of the printer 10, for example, de-energizing the heat source of the fixing unit 15, or rotating the heat roller 15*a* and pressure roller 15*b* and other rollers in an idle manner. This allows for performing high speed printing.

In the embodiment, an amount of heat transferred to the toner reservoir 13C and the image forming section 14C is not so significant as can be detected by temperature sensors, not shown, in the toner reservoir 13C and the image forming section 14C. Thus, melting of the toner in the toner reservoir 13C and the toner in the image forming section 14C can be prevented reliably.

The fan 27 may be a d-c fan motor type, an a-c fan motor type, or a sirocco fan. When a sirocco fan is employed, the width of an air discharging opening can be larger than the width of the fixing unit 15.

The first embodiment has been described with respect to a printer 10 in which paper is transported in a horizontal direction. The present invention may also be applied to a printer in which paper is transported in a vertical direction.

SECOND EMBODIMENT

Elements similar to those in the first embodiment have been given the same reference numerals and their description is omitted.

Figure 3:
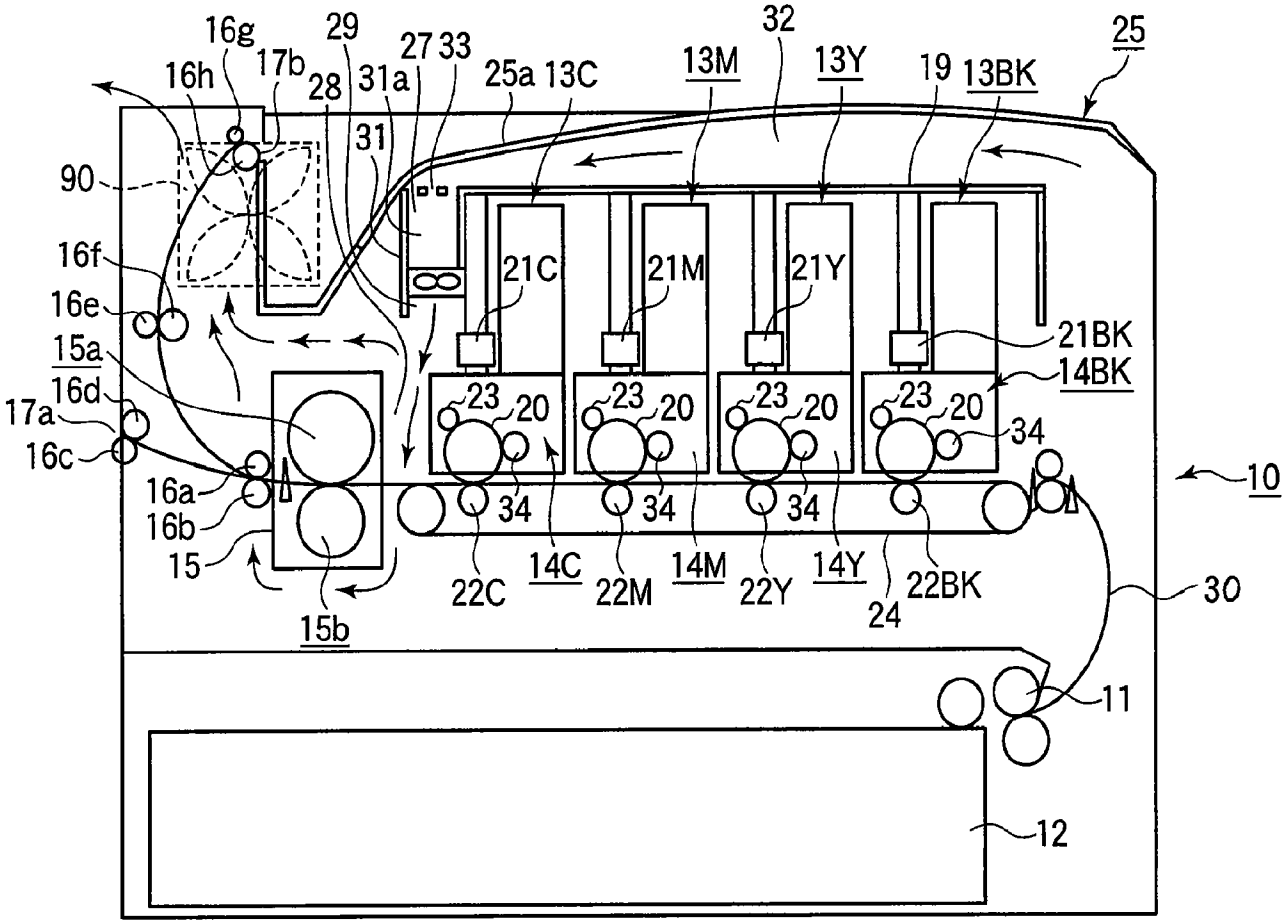
FIG. 3 illustrates the general configuration of a printer of a second embodiment.
Figure 4:
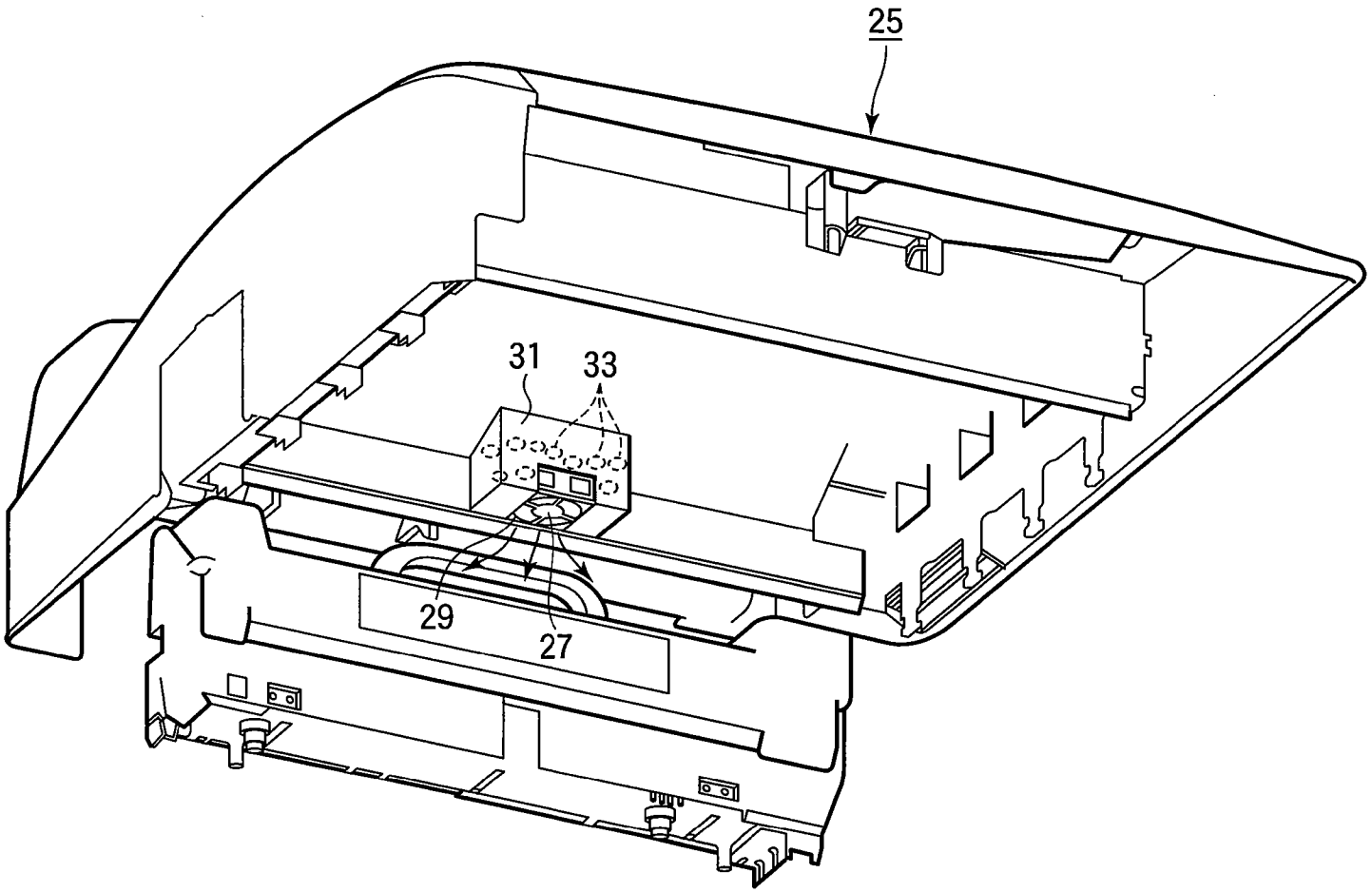
FIG. 4 is a perspective view illustrating a pertinent portion of the printer of the second embodiment.

FIG. 3 illustrates the general configuration of a printer 10 of a second embodiment. FIG. 4 is a perspective view illustrating a pertinent portion of the printer 10.

A first path 28 is defined between the image forming section 14C and the fixing unit 15. A second path 32 is defined between an outer case 25 and a partition 19 that overlies toner reservoirs. An air chamber 31 defines a third path 31*a* between the first path 28 and the second path 32. The second path 32 and the third path 31*a* communicate with each other through openings 33 formed in the upper wall of the air chamber 31.

The air chamber 31 is located beside the toner reservoir 13C and substantially over the first path 28 defined between the image forming section 14C and the fixing unit 15.

The fan 27 rotates to suck in the relatively cool air into the air chamber 31 from the second path 32 that is away from the fixing unit 15. Then, the fan 27 ejects the air from the air chamber 31 through a wind exit 29 into the first path 28, thereby primarily cooling the image forming section 14C. The flow of air forms a curtain of air such that the fixing unit is on one side of the curtain of air and the developer reservoir 13C and image forming section 14C are on the other side of the curtain of air.

As described above, the fan 27 causes the air to flow through the upper interior portion (i.e., second path 32) of the printer 10 to the air chamber 31. The fan 27 creates a flow of air of a lower temperature in the second embodiment than in the first embodiment, so that cooling effect is better in the second embodiment than in the first embodiment.

THIRD EMBODIMENT

Elements similar to those in the first and second embodiments have been given the same reference numerals and their description is omitted.

Figure 5:
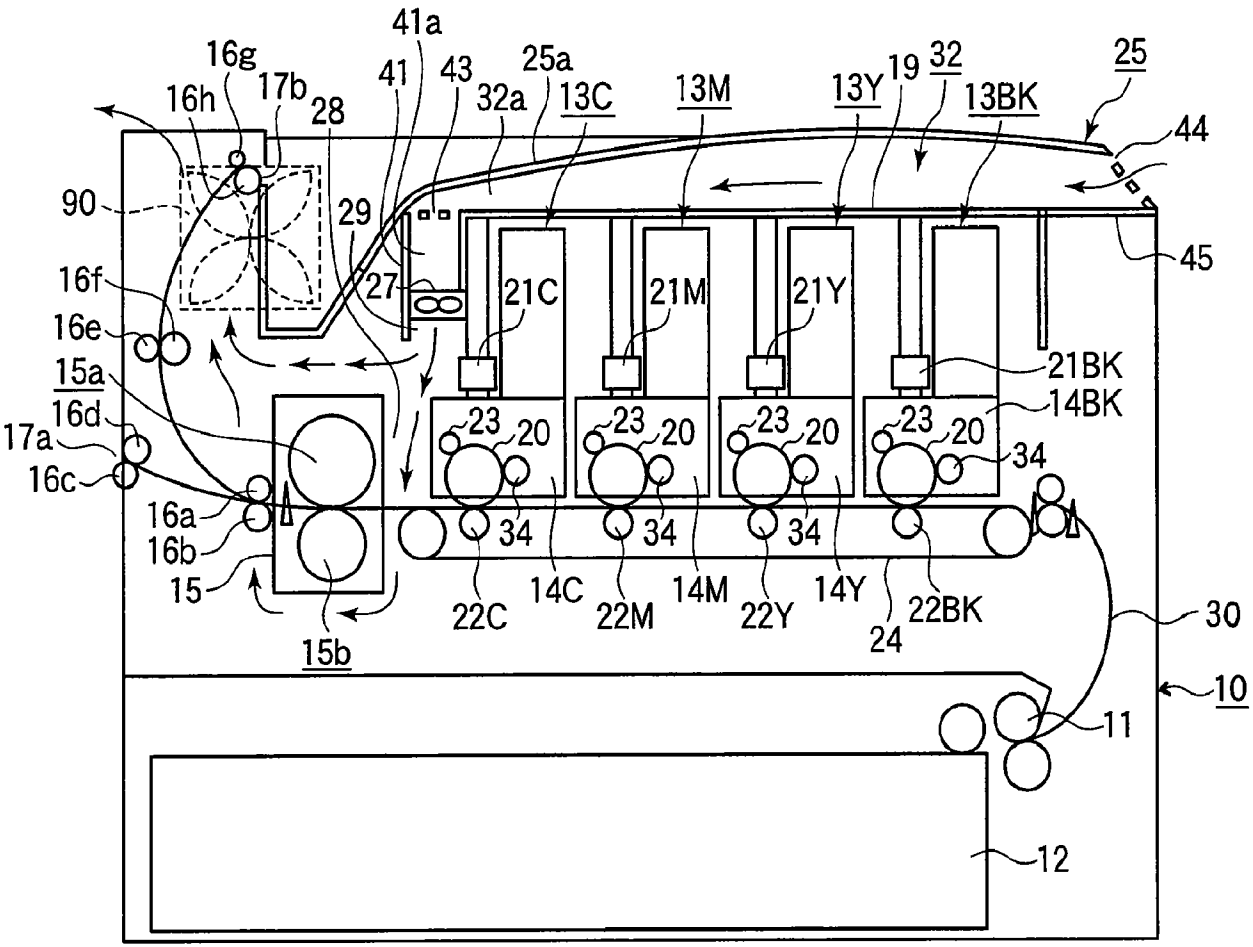
FIG. 5 illustrates the general configuration of a printer of a third embodiment.
Figure 6:
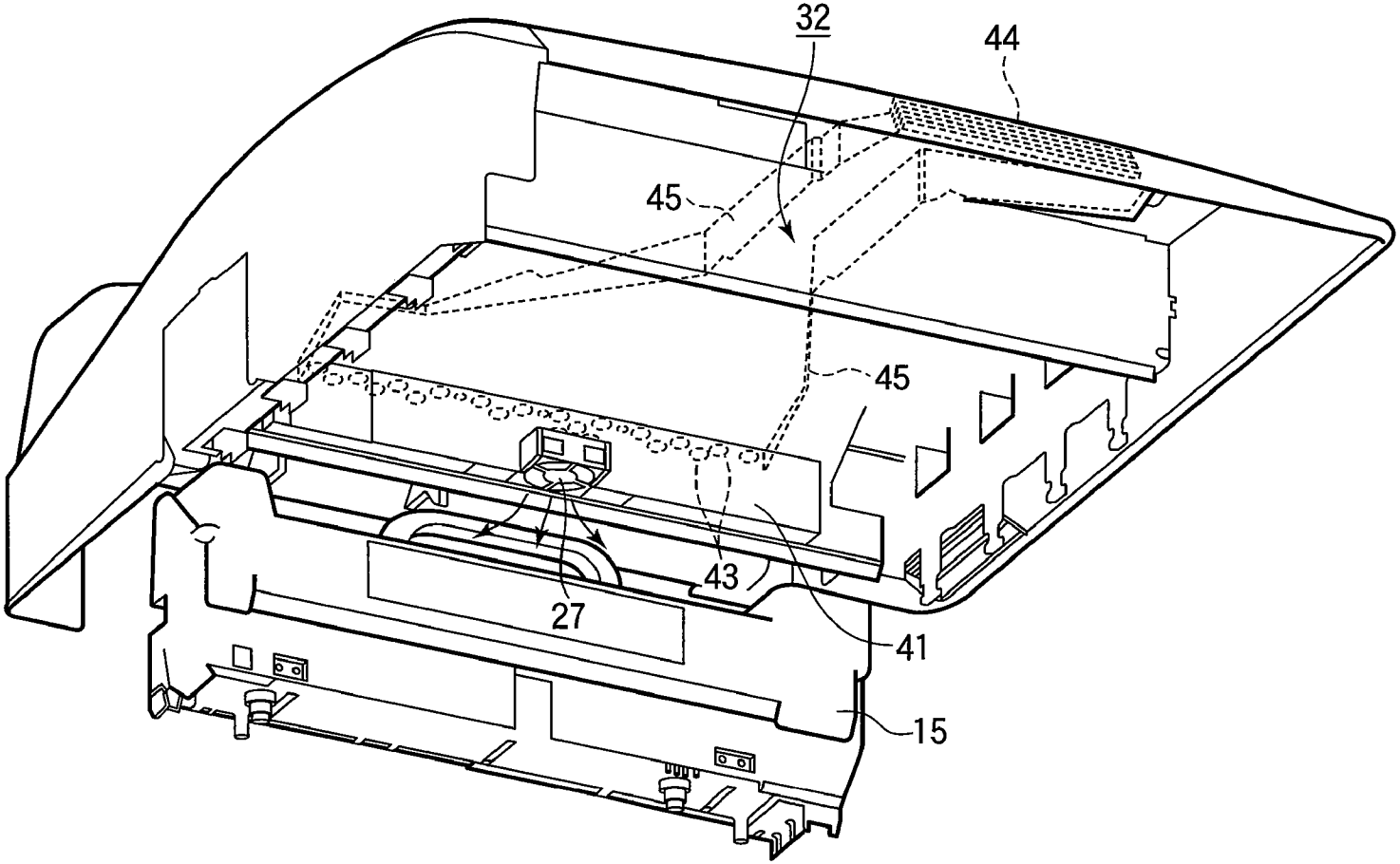
FIG. 6 is a perspective view illustrating a pertinent portion of the printer of the third embodiment.

FIG. 5 illustrates the general configuration of a printer 10 of third embodiment. FIG. 6 is a perspective view illustrating a pertinent portion of the printer 10 with a partition 19 (FIG. 5) omitted for the sake of simplicity.

Referring to FIG. 5, a first path 28 is defined between the image forming section 14C and the fixing unit 15. A second path 32 is defined by an outer case 25, two opposing walls 45 (FIG. 6), and the partition 19 that overlies toner reservoirs 13BK, 13Y, 13M, and 13C. An air chamber 41 defines a third path 41*a* between the first path 28 and the second path 32. The air chamber 41 and the second path 32 communicate with each other through openings 43. As shown in FIG. 6, the air chamber 41 is in the shape of a rectangular box that longitudinally extends parallel to the fixing unit 15.

The second path 32 has openings 44 formed in the vicinity of the image forming section 14BK, i.e., upstream of the direction of travel of the paper through the image forming sections 14C, 14M, 14Y, and 14BK, or as far a location as possible from the fixing unit 15.

The height of opposing walls 45 becomes lower nearer the openings 43 and the distance between the opposing walls 45 becomes longer nearer the openings 43.

Referring to FIG. 6, the air chamber 41 communicates with the second path 32 through the openings 43, so that a large volume of air can be supplied into the air chamber 41.

The fan 27 sucks the air from the outside of the printer 10 through the openings 44. The air is directed through the second path 32 into the air chamber 41. Then, the fan 27 ejects the air from the air chamber 41 through a wind exit 29 into the first path 28. The flow of air forms a curtain of air such that the fixing unit is on one side of the curtain of air and the developer reservoir 13C and image forming section 14C are on the other side of the curtain of air. The air entering the first path 28 efficiently cools the image forming section 14C. Therefore, cooling can be achieved by the use of fresh air, the temperature of the fresh air being lower than that of the air in the printer 10.

FOURTH EMBODIMENT

Elements having the same construction as those in the first to third embodiments have been given the same reference numerals, and their description is omitted.

When a large volume of document is printed, a significant amount of heat is lost to the paper, so that the surface temperatures of the heat rollers 15*a* and 15*b* are lower at areas in contact with the paper than at areas not in contact with the paper.

The heat rollers 15*a* and 15*b* have a length such that when the paper of a maximum size is fed to the heat rollers 15*a* and 15*b* in a laterally centered position, the length is larger than the width of the paper. Thus, the heat rollers 15*a* and 15*b* loses more heat to the paper at a portion closer to the middle of the heat rollers than at longitudinal end portions, so that the temperature is much higher at the longitudinal end portions than at the portion closer to the middle portion. If temperature control is performed with reference to the detection output of a temperature sensor disposed in the vicinity of a longitudinal end portion of the heat roller 15*a* or 15*b*, the temperature in the longitudinally middle portions of the heat rollers 15*a* and 15*b* would be much lower than that at the longitudinal end portions.

Figure 7:
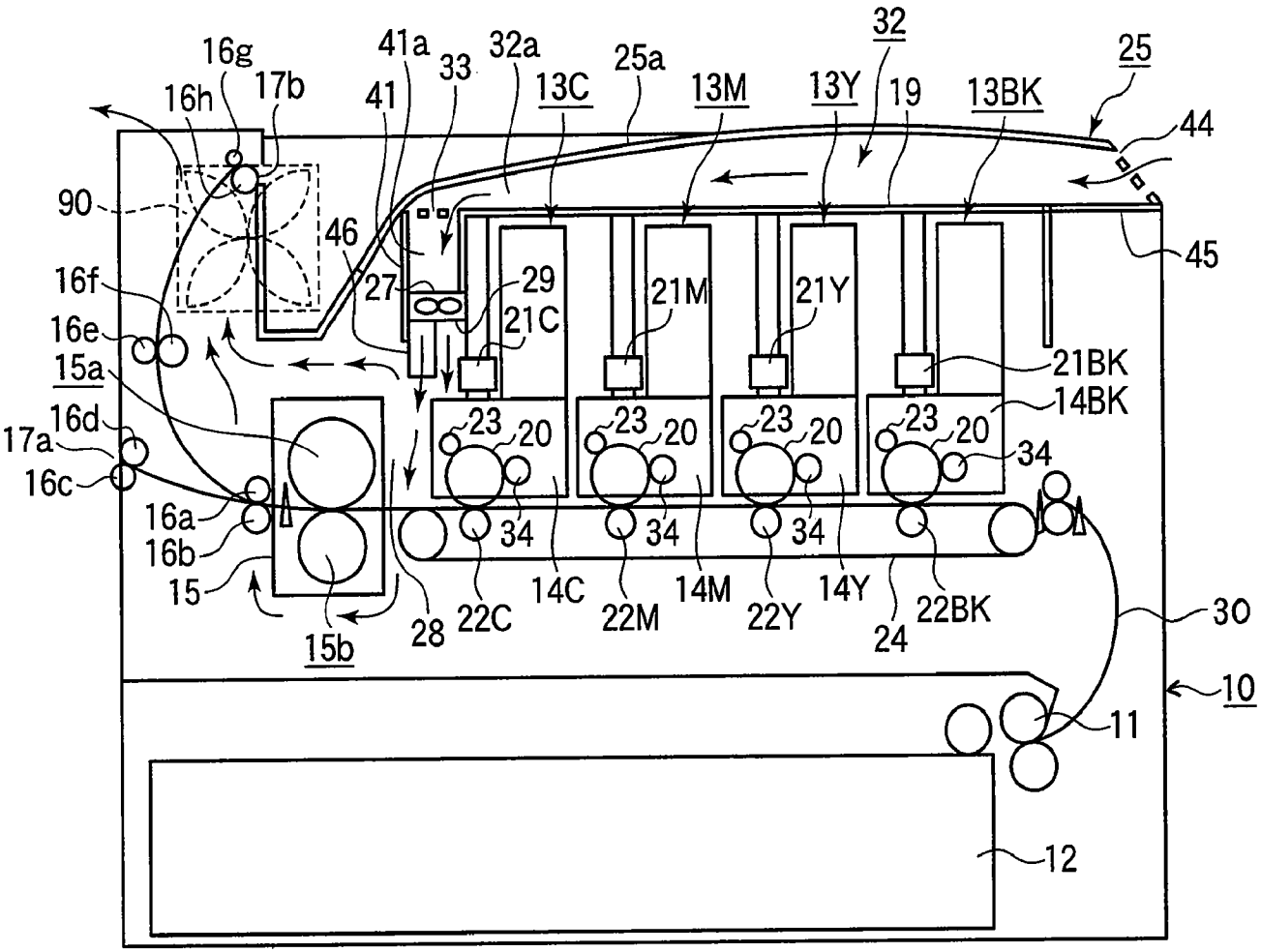
FIG. 7 illustrates a printer of a fourth embodiment.
Figure 8:
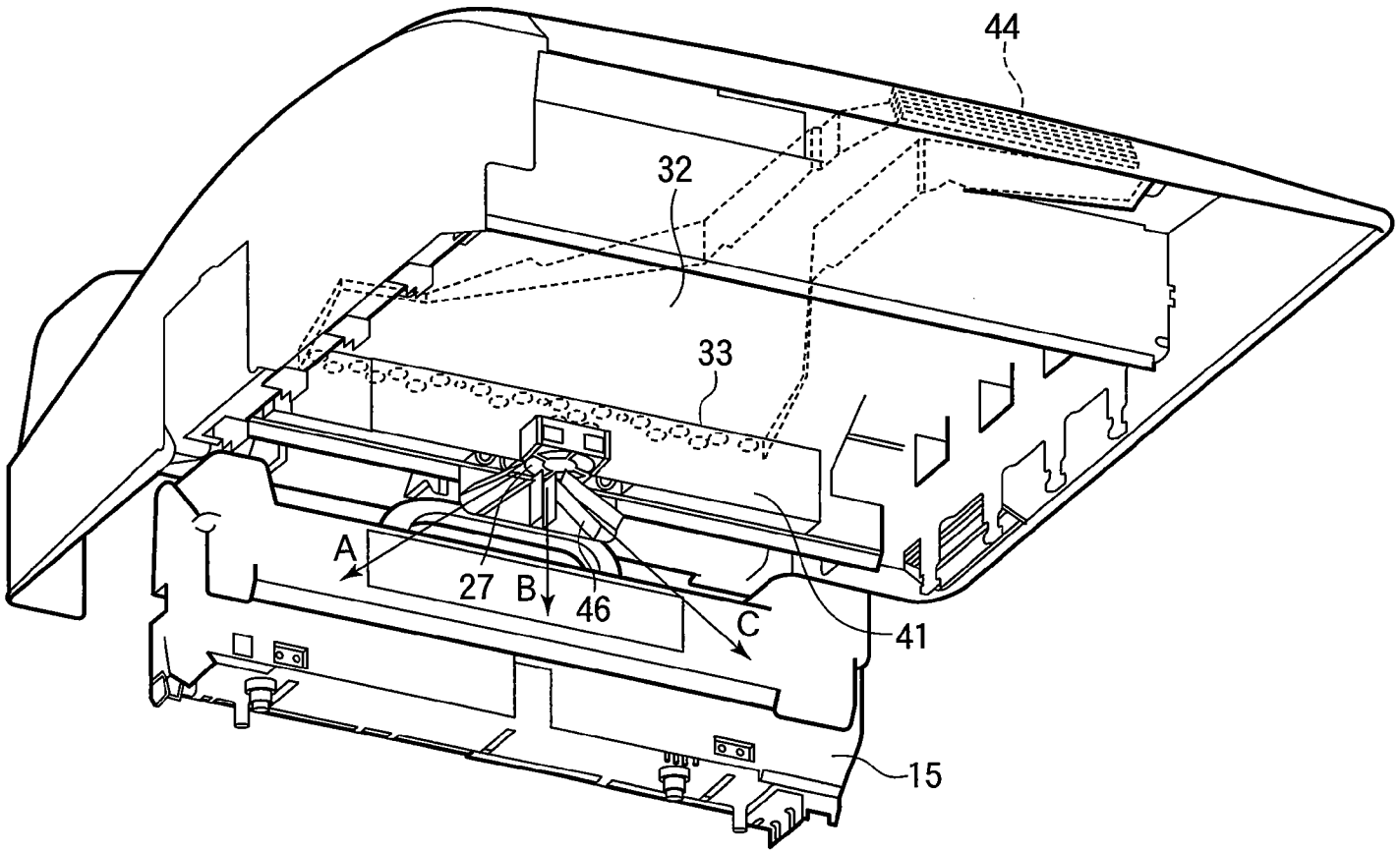
FIG. 8 is a perspective view illustrating a pertinent portion of the printer of the fourth embodiment.
Figure 9:
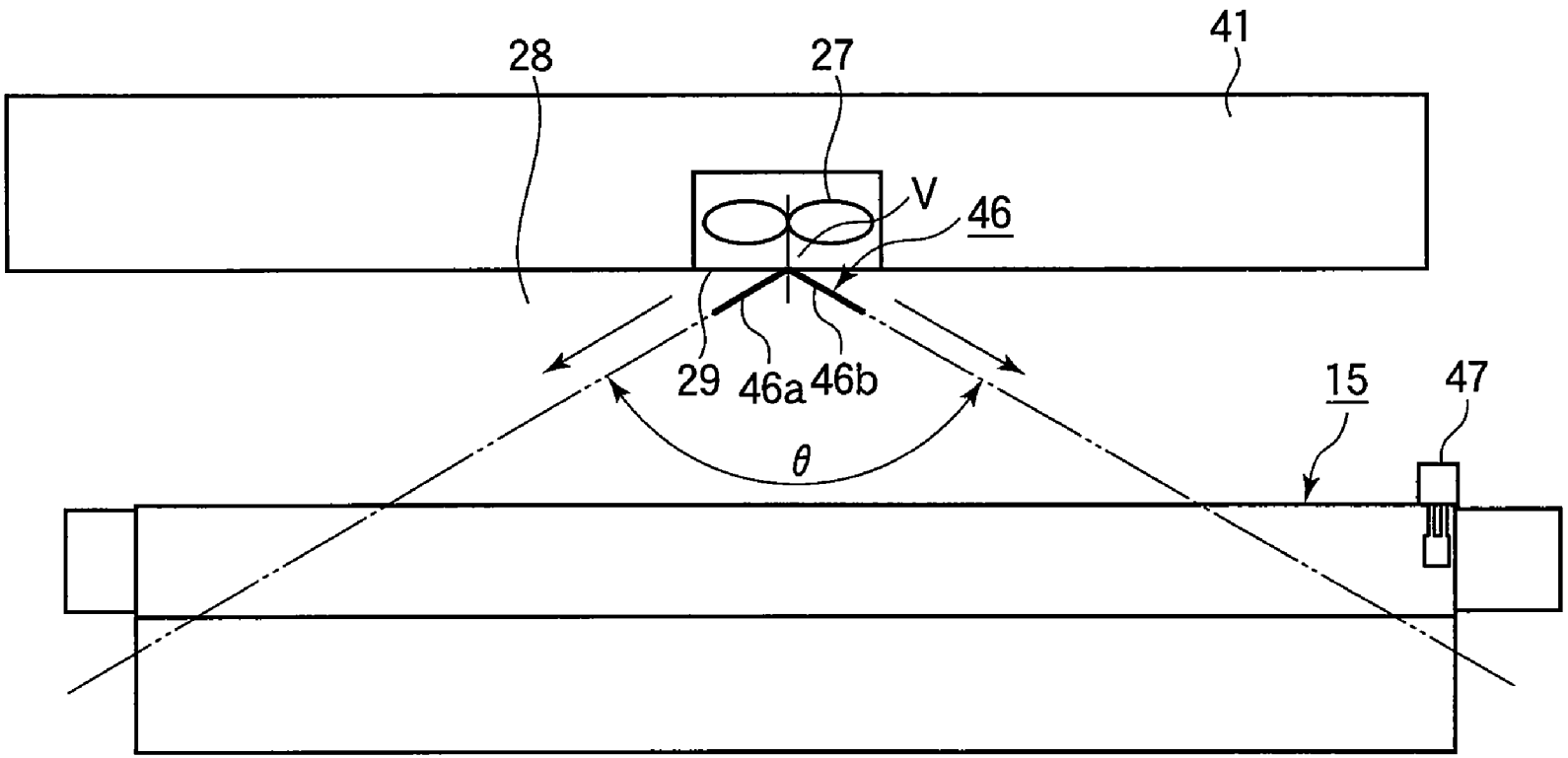
FIG. 9 illustrates the flow of air at a first path.

FIG. 7 illustrates a printer 10 of a fourth embodiment. FIG. 8 is a perspective view illustrating a pertinent portion of the printer with a partition 19 (FIG. 7) omitted for the sake of simplicity. FIG. 9 illustrates the flow of air guided by a wind guide 46.

Referring to FIG. 7, air is blown into a first path 28 between an image forming section 14C and a fixing unit 15. The wind guide 46 is provided at a wind exit 29. The wind guide 46 includes plates 46*a* and 46*b* arranged to form the shape of a "V." The wind guide 46 is aligned with the fan 27 such that the "vertex" V of the V-shape is in line with a rotational axis of at the center. The wind guide 46 guides the wind produced by the fan 27 to move along the plates 46*a* and 46*b*, so that the temperature of longitudinal end portions of the fixing unit 15 is prevented from increasing.

A second path 32 is defined by an outer case 25, two opposing walls 45, and the partition 19 that overlies toner reservoirs 13BK, 13Y, 13M, and 13C.

It is to be noted that the wind guide 46 is disposed downstream of the fan 27 such that the wind guide 46 occupies half the cross section of the wind exit 29 closer to the fixing unit 15. Thus, a portion of the wind passing through another half the cross section of the wind exit 29 closer to the image forming section 14C is not guided by the wind guide 46 but flows straightly out of the wind exit 29 into the lengthwise middle of the first path 28. In this manner, the resultant wind is substantially uniformly distributed across the entire length of the first path 28. Referring to FIG. 8, arrows A and C shows the direction in which the wind is guided by the plates 46*a* and 46*b* of the wind guide 46 and arrow B shows the direction in which the wind is not guided by the wind guide 46 but is discharged straightly out of the wind exit 29. It is to be noted that the flow of air forms a curtain of air such that the fixing unit is on one side of the curtain of air and the developer reservoir and image forming section are on the other side of the curtain of air.

This way of distributing the wind prevents the fixing unit 15 from being cooled preferentially in its middle and allows the fixing unit to be cooled at its longitudinal end portions.

Referring to FIG. 9, if a temperature sensor 47 for detecting the temperature of the fixing unit 15 is disposed in the vicinity of an end of the fixing unit 15, the angle θ formed between the plates 46*a* and 46*b* may be modified such that the portion of the wind divided by the plates 46*a* and 46*b* is blown onto the temperature sensor 47.

While the wind guided by the wind guide 46 is aimed primarily at the longitudinal end portions of the first path 28, a portion of the wind guided by the wind guide 46 also blows onto the fixing unit 15 and temperature sensor 47 to cool down the longitudinal end portions of the fixing unit 15 and their vicinity which would otherwise remain at high temperature. On the other hand, while the wind not guided by the wind guide 46 is aimed primarily at the middle portion of the first path 28, a portion of the wind not guided by the wind guide 46 also blows onto the lateral center of the image forming section 14C, so that the toner at any part in the image forming section 14C is prevented from melting.

As described above, the variation of cooling effect along the length of the fixing unit 15 may be minimized, so that the temperature control of the fixing unit 15 can be accomplished properly.

FIFTH EMBODIMENT

Elements having the same construction as those in the first to fourth embodiments have been given the same reference numerals and their description is omitted.

Figure 10:
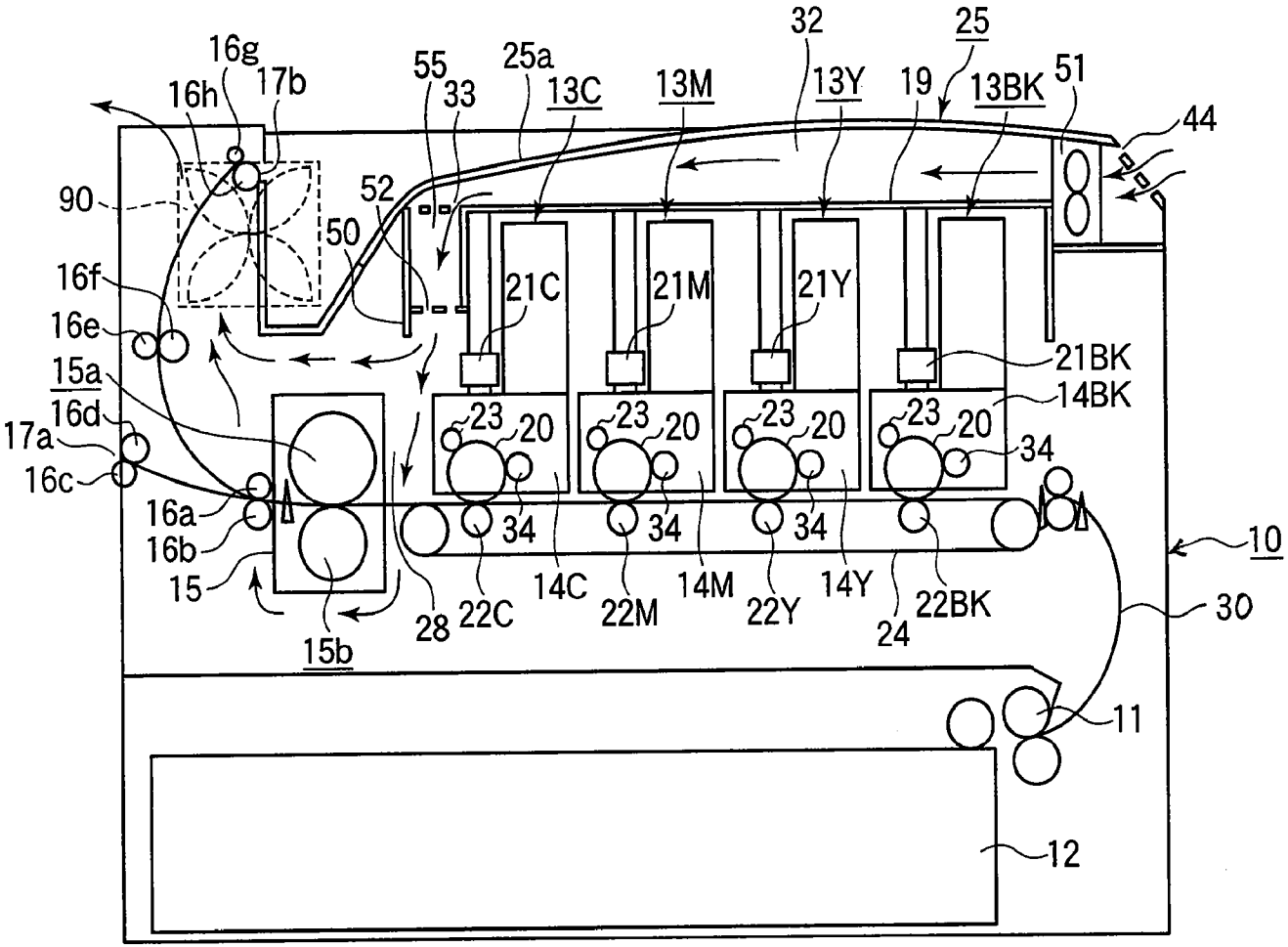
FIG. 10 illustrates the outline of a printer of a fifth embodiment.
Figure 11:
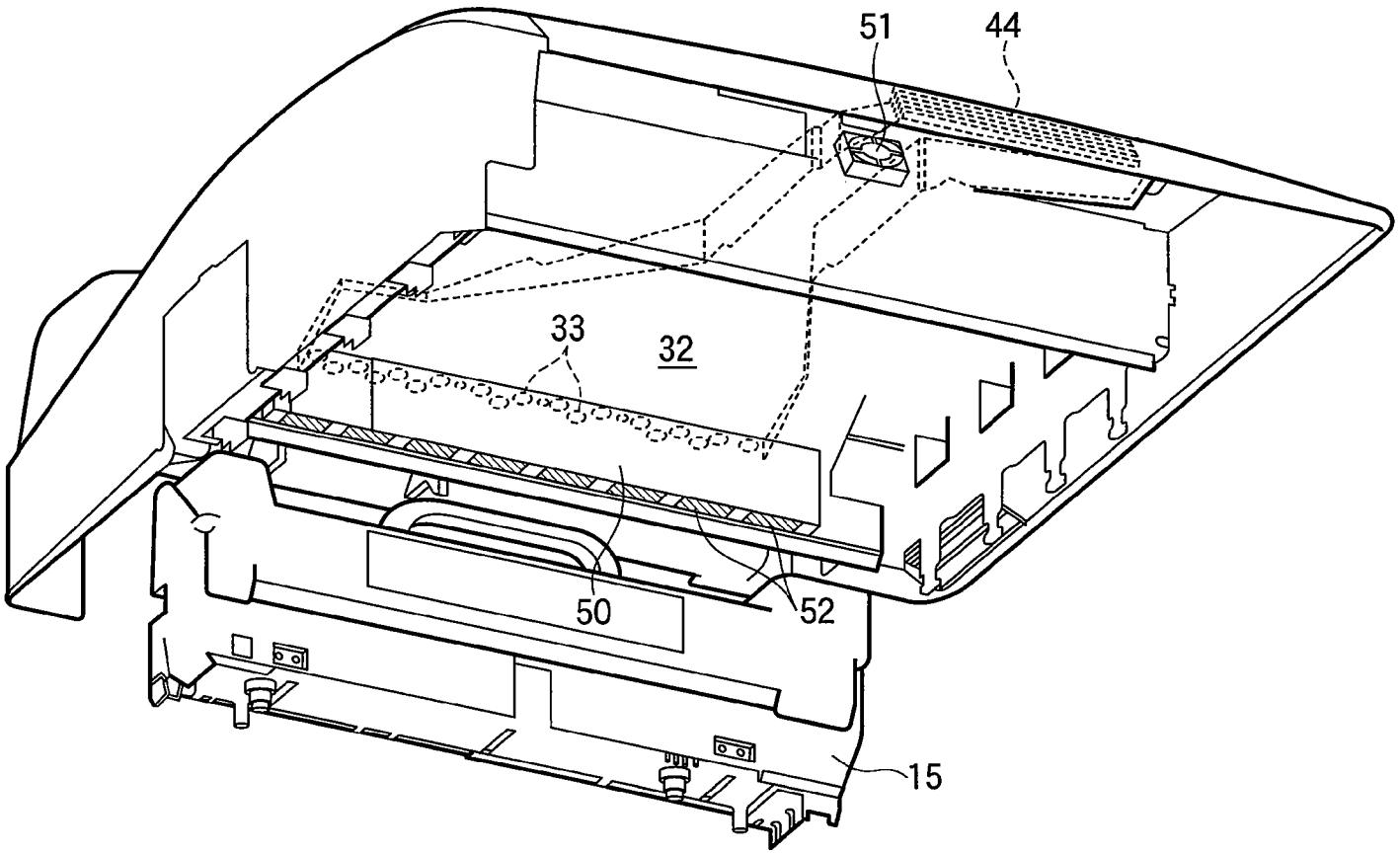
FIG. 11 is a perspective view of the printer of the fifth embodiment.

FIG. 10 illustrates the outline of a printer 10 of a fifth embodiment. FIG. 11 is a perspective view of the printer 10 with a partition 19 (FIG. 10) omitted for the sake of simplicity.

Openings 44 are formed in an outer case 25 in the vicinity of the image forming section 14BK, i.e., upstream of the direction of travel of the paper through the image forming sections 14BK, 14Y, 14M, and 14C or as far a location as possible from the fixing unit 15. A fan 51 is disposed inside of the outer case 25 and upstream of a second path 32 to suck the fresh air from the atmosphere through the openings 44.

The toner reservoir 13C is the closest one of toner reservoirs 13BK, 13Y, 13M, and 13C to the fixing unit 15. An ejecting duct 50 is disposed to substantially overlie a first path 28 defined between the fixing unit 15 and the image forming section 14C. The ejecting duct 50 extends across the entire width of the transport path 30 in a direction perpendicular to the direction of travel of the paper.

The ejecting duct 50 defines a third path 55, and has wind exits 52 that are distributed across the entire width of the transport path 30 and communication openings 33. A fan 51 sucks the fresh air and causes the air to flow through the second path 32, the communication openings 33, and the third path (air chamber) 55, the flow of air finally being ejected into the first path 28. The second path 32 is defined by an outer case 25, two opposing walls 45, and the partition 19 that overlies toner reservoirs 13BK, 13Y, 13M, and 13C. The third path 55 is defined between the second path 32 and the first path 28.

The fan 51 rotates to suck the fresh air through the openings 44 from the outside of the printer 10. The air is then directed through the second path 32 to the ejecting duct 50, which in turn ejects the air to the first path 28. The air entering the first path 28 efficiently cools the image forming section 14C. It is to be noted that the flow of air forms a curtain of air such that the fixing unit 15 is on one side of the curtain of air and the developer reservoir 13C and image forming section 14C are on the other side of the curtain of air. This flow of air is advantageous in that cooling is accomplished by using the fresh air of low temperature.

Because the wind exits 52 are formed to distribute across the entire width of the transport path 30, the wind is allowed to flow not only through the middle portion of the width of the ejecting duct 50 but also through the widthwise end portions, so that the wind flows into the first path 28 across the entire wind exits 52. The wind flowing into the first path 28 is also effective in preventing the temperature at the longitudinal end portions of the fixing unit 15 from increasing.

Alternatively, the ejecting duct 50 may be disposed to blow the air only onto the middle portion of the fixing unit 15. Still alternatively, the ejecting duct 50 may have a guide similar to the wind guide 46 of the fourth embodiment.

The space in the vicinity of the openings 44 is larger than that in the vicinity of the image forming section 14C, toner reservoir 13C, and fixing unit 15 is quite small. Thus, the fan 51 can be larger in size when it is disposed in the vicinity of the openings 44 than when it is disposed in the vicinity of the image forming section 14C, toner reservoir 13C, and fixing unit 15. Thus, for example, the fan 51 disposed in the vicinity of the openings 44 can be a powerful one that produces a large amount of wind. This improves cooling efficiency of the fixing unit 15.

SIXTH EMBODIMENT

Elements similar to those in the first to fifth embodiments have been given the same reference numerals and their description is omitted.

Figure 12:
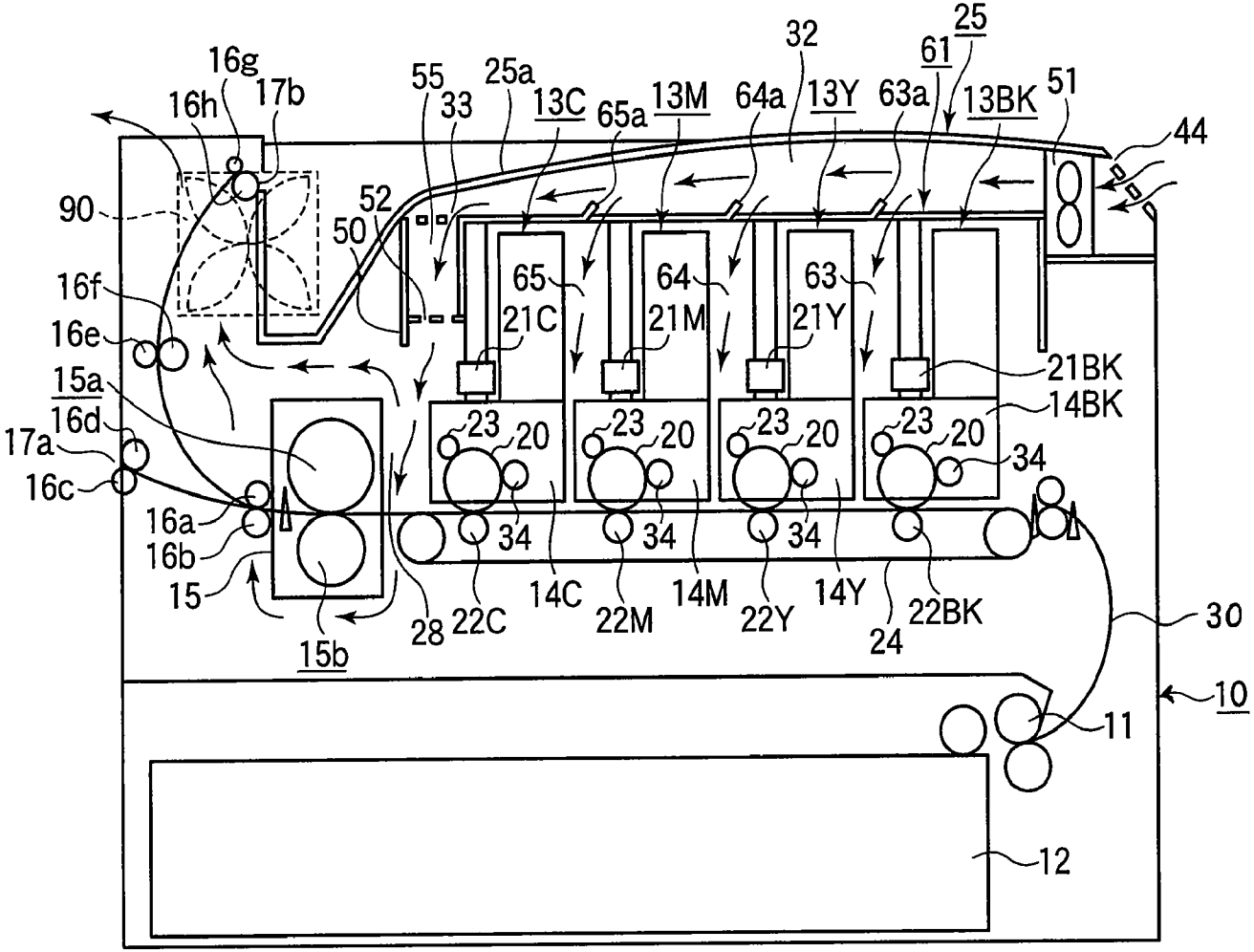
FIG. 12 illustrates the general configuration of a printer of a sixth embodiment.

FIG. 12 illustrates the general configuration of a printer 10 of a sixth embodiment.

Openings 44 are formed in an outer case 25, and a fan 51 is disposed on the inside of the outer case 25 to suck the fresh air into the printer 10 through the openings 44.

Small parts of a partition 61 are raised to form openings 63*a*, 64*a*, and 65*a*. Specifically, at three points in the partition 61, U-shaped slits are formed and the interior of the U-shaped part is partially bent upward to form openings 63*a*, 64*a*, and 65*a* through which a portion of the fresh air is branched into fourth paths or spaces 63, 64, and 65 defined between adjacent toner reservoirs 13BK, 13Y, and 13C.

Thus, the fan 51 sends the air not only through a second path 32, openings 33, a third path (air chamber) 55, wind-exists 52, and a first path 28 but also through the openings 63*a*, 64*a* and 65*a* into the fourth paths or spaces 63, 64, and 65.

The air that is flowing into the fourth paths or spaces 63, 64, and 65 cools the toner reservoirs 13BK, 13Y, 13M, and 13C and the image forming sections 14BK, 14Y, 14M, and 14C. A fan 90 sucks the air flowing through the spaces 63, 64, and 65 to create a flow of air that eventually cools down the fixing unit 15.

Although the first to sixth embodiments have been described with respect to a color printer, the present invention may also be applicable to other apparatuses such as facsimile machines copying machines, and multifunction printers. The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus comprising:

an image forming section that forms a developer image;

a transferring section that transfers the developer image onto a recording medium;

a fixing unit located adjacent said image forming section such that a space is defined between said fixing unit and said image forming section, said fixing unit fixing the developer image on the recording medium;

an air-chamber including a wind exit and discharging air through the wind exit such that the air flows into the space; and an air-propelling device that propels the air to discharge through the wind exit, wherein said image forming section and said fixing unit extend such that the space extends in a first direction substantially perpendicular to a second direction in which the recording medium is fed into said fixing unit, and wherein the image forming apparatus includes a wind guide disposed downstream of the wind exit, said wind guide guiding the air to flow into longitudinal end portions of the space.

2. The image forming apparatus according to claim 1, wherein said fixing unit longitudinally extends in a first direction perpendicular to a second direction in which the recording medium is fed into said fixing unit, and the wind exit is located substantially longitudinal midway of said fixing unit.

3. The image forming apparatus according to claim 1, wherein the space is a first space and the image forming apparatus further comprising an outer casing that defines a second space in the image forming apparatus;

wherein said air-chamber defines a third space upstream of the wind exit, the third space communicating with the second space through a communication hole formed in said air-chamber.

4. The image forming apparatus according to claim 3, further comprising said outer casing that defines the second space over said image forming section.

5. The image forming apparatus according to claim 3, wherein said third space is substantially in the shape of a box that extends in parallel to said fixing unit.

6. The image forming apparatus according to claim 3, wherein said outer casing is formed with an opening at an upstream portion of the second space, the second space communicating with an atmosphere through the opening.

7. The image forming apparatus according to claim 6, wherein said outer casing includes a pair of opposing walls that project from said outer casing to define the second space.

8. The image forming apparatus according to claim 1, wherein said air-propelling device is a fan disposed immediately upstream of the wind exit.

9. The image forming apparatus according to claim 1, wherein the space extends in a longitudinal direction and the wind exit is disposed between longitudinal ends of the space and said wind guide includes a plate that extends from the wind exit in a direction oblique to a direction in which the air is discharged through the wind exit, the plate guiding the air toward one of the longitudinal ends of the space.

10. The image forming apparatus according to claim 9, wherein said wind guide guides the air that exits substantially a half of the wind exit closer to said fixing unit.

11. The image forming apparatus according to claim 10, wherein the air-propelling device is a fan disposed immediately upstream of the wind exit.

12. The image forming apparatus according to claim 9, wherein said air-propelling device is a fan disposed immediately upstream of the wind exit.

13. The image forming apparatus according to claim 1, wherein said wind guide guides the air that exits substantially a half of the wind exit closer to said fixing unit.

14. An image forming apparatus comprising:

an image forming section;

a fixing unit spaced from the image forming section such that a cooling space is defined between the fixing unit and the image forming section, the cooling space having a lateral width;

a transferring section extending between the image forming section and the fixing unit and through the cooling space;

an air-chamber filled with air and having a chamber exit positioned proximate the cooling space;

an air-propelling device proximate the chamber exit and propelling the air within the air-chamber through the chamber exit; and a wind guide disposed downstream of the chamber exit directing the air exiting the chamber exit into the cooling space and guiding the air laterally to fill the cooling space along the lateral width of the cooling space.

* * * * *